US007034684B2

(12) United States Patent
Boman et al.

(10) Patent No.: US 7,034,684 B2
(45) Date of Patent: Apr. 25, 2006

(54) PERSONAL ITEM MONITOR USING RADIO FREQUENCY IDENTIFICATION

(75) Inventors: Robert C. Boman, Thousand Oaks, CA (US); Brian Hanson, Goleta, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 219 days.

(21) Appl. No.: 10/751,851

(22) Filed: Jan. 6, 2004

(65) Prior Publication Data

US 2005/0148339 A1 Jul. 7, 2005

(51) Int. Cl.
*G08B 13/14* (2006.01)

(52) U.S. Cl. ..... 340/568.1; 340/572.1; 340/539.11; 340/539.32

(58) Field of Classification Search ..... 340/568.1, 340/572.1, 572.4, 686.1, 686.6, 539.11, 539.13, 340/539.32; 455/404.1, 404.2, 421
See application file for complete search history.

(56) References Cited

U.S. PATENT DOCUMENTS 5,939,981 A * 8/1999 Renney ..... 340/539.32
6,133,832 A * 10/2000 Winder et al. ..... 340/572.1
6,331,817 B1 * 12/2001 Goldberg ..... 340/573.1
6,501,378 B1 * 12/2002 Knaven ..... 340/539.1
6,624,752 B1 * 9/2003 Klitsgaard et al. ..... 340/572.1
6,674,364 B1 * 1/2004 Holbrook et al. ..... 340/568.1
6,788,199 B1 * 9/2004 Crabtree et al. ..... 340/539.13
6,850,151 B1 * 2/2005 Calhoun et al. ..... 340/309.16
2002/0174025 A1 11/2002 Hind et al.
2003/0120745 A1 6/2003 Katagishi et al.

OTHER PUBLICATIONS

"Purse Guard Monitor Alarm", http://www.purseguard.homestead.com/purseguard-ns4.html, 1 page.

* cited by examiner

*Primary Examiner*—Toan N. Pham
(74) *Attorney, Agent, or Firm*—Harness, Dickey & Pierce, PLC

(57) ABSTRACT

A personal item monitoring system includes a monitor having a transmitter and a receiver located therein. At least one radio identification tag is adapted to be coupled to a personal item. Alternatively, the radio identification tag may be pre-installed into the personal item. The monitor emits a radio frequency received by the radio frequency identification tag, and the radio frequency identification tag emits a responding signal if within a detection range. The monitor then alerts a user if the radio identification tag leaves the range of detection.

25 Claims, 3 Drawing Sheets

PERSONAL ITEM MONITOR USING RADIO FREQUENCY IDENTIFICATION

FIELD OF THE INVENTION

The present invention relates to electronically monitoring the location of personal items, and more particularly to a personal item monitor using radio frequency identification to electronically monitor the location of personal items.

BACKGROUND OF THE INVENTION

It is common for people to carry small objects on their person such as, for example, keys, wallets, cellular phones, PDAs, purses, and glasses. Unfortunately, due to their small size, it is not uncommon for these personal items to be misplaced. If these objects are lost or stolen, it is at best very inconvenient and at worst financially destructive. Accordingly, a system which automatically warns the user when a personal item carried on the person is missing would be very useful.

Currently, there are some products that exist that attempt to address this issue. For example, one such product includes a transmitter and receiver. The receiver is carried with the user and the transmitter is placed in the user's personal item, typically a purse. When the transmitter is moved more than certain distance away from the receiver, the receiver sounds an alarm, thus indicating that the purse or other large item has been left behind. However, there are several limitations to these devices. For example, the transmitter is much too large to monitor small devices such as keys, wallets, or glasses. Moreover, both the transmitter and the receiver must use battery power at each end for the system to operate (and batteries are relatively bulky and periodically require replacement). If the user fails to carry the receiver, the system is useless. Finally, both the receiver and the transmitter must be turned on for each use.

With the above limitations of the current technology in mind, there is room in the art for a personal item monitor that overcomes these limitations.

SUMMARY OF THE INVENTION

A personal item monitoring system includes a monitor having a transmitter and a receiver located therein. At least one radio frequency identification tag is adapted to be coupled to a personal item. Alternatively, the radio identification tag may be preinstalled into the item. The monitor emits a radio frequency received by the radio frequency identification tag, and the radio frequency identification tag emits a responding signal if within a detection range. The monitor then alerts a user if the radio identification tag leaves the range of detection.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
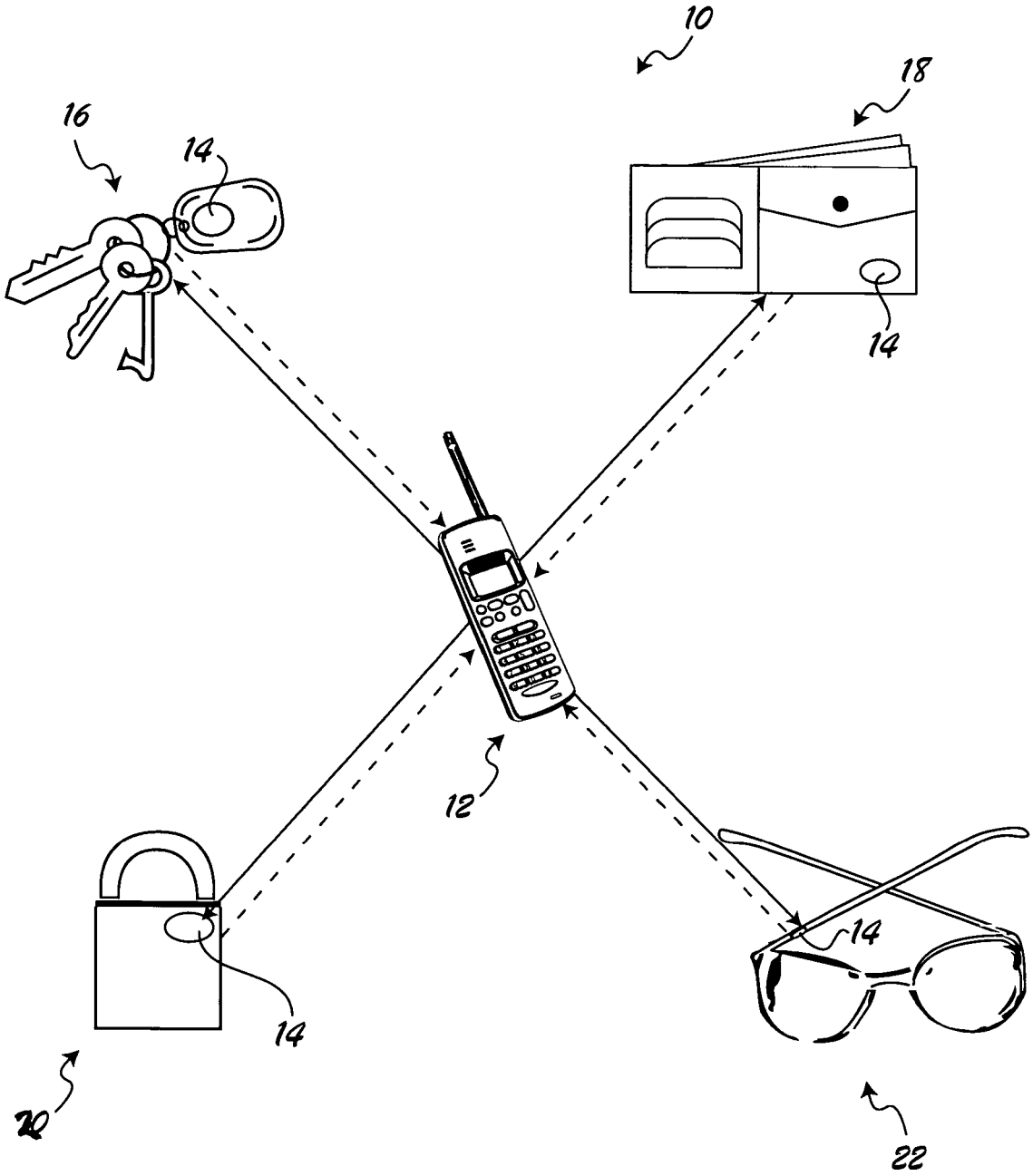
FIG. 1 is an exemplary illustrative view of a personal item monitoring system constructed according to the principles of the present invention.

With reference to FIG. 1, a personal item monitoring system (PIMS) is generally indicated by reference numeral 10. The PIMS 10 generally includes a monitor 12 and a plurality of radio frequency identification tags (RFID tags) 14. Used herein, the term "radio frequency identification tag" refers to any device which wirelessly transmits an identification signal in response to a wireless query signal. Additionally, such a device is expected to be small in size and does not require a renewable power source (i.e. a battery that requires periodic replacement). Moreover, in the particular example provided, the monitor 12 is illustrated as a cellular phone. However, it is to be appreciated that various other devices may be used as the monitor 12, for example, a PDA or a dedicated transmitter/receiver. Generally speaking, both RFID tags and cellular telephones use UHF frequencies. In Europe, RFID tags commonly use 868 MHz and in the United States, RFID tags use 915 MHz frequencies. Cellular phones typically use either 800 MHz or 1900 MHz bands, with many cellular phones supporting both. Because the frequencies of typical RFID tags and cellular phones are similar and because cellular phones already have a transmitter/receiver located therein, cellular phones make ideal monitors for housing a built-in RFID reading capability.

The RFID tags 14 of the present invention include a small electronic chip (not shown) with a radio frequency transponder (not shown). Preferably, the RFID tags 14 include an adhesive sticker (which may include a printed logo) having the electronic chip embedded therein. The RFID tags 14 may then be adhesively attached to any number of items, for example, a first item 16, a second item 18, a third item 20, and a fourth item 22. As illustrated in FIG. 1, items 14, 18, 20, 22 are, respectively, keys, a wallet, a purse, and glasses. It should be appreciated, however, that any number and kind of items may be tagged. Alternatively, the RFID tags 14 may be already imbedded in the personal items directly.

The monitor 12 emits a radio signal that is received by the RFID tags 14. The electronic radio frequency transponder located within the RFID tags 14 in turn responds with a returning radio signal. This returning radio signal from the RFID tags 14 is received by the monitor 12.

Figure 2:
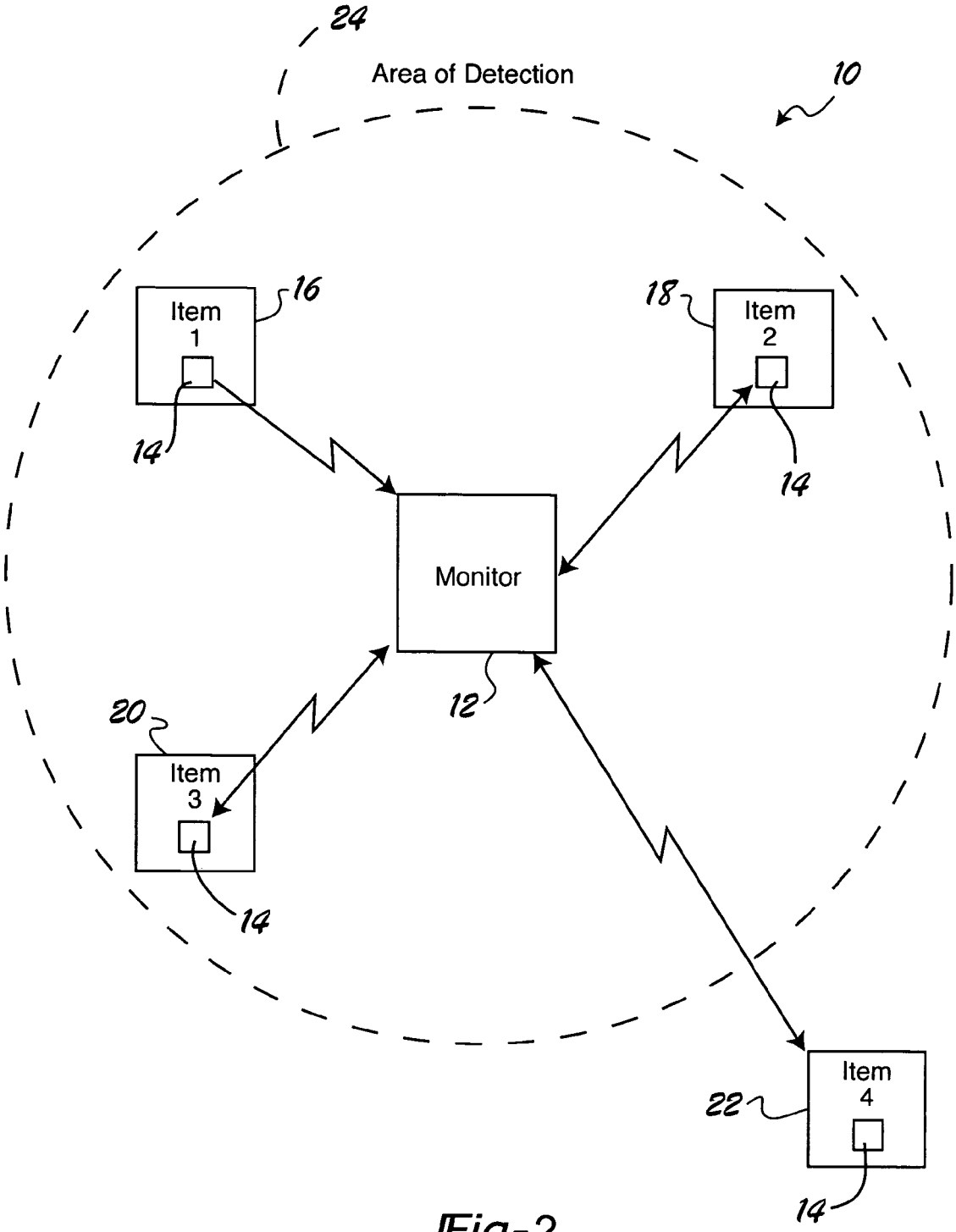
FIG. 2 is a schematic view of the personal item monitoring system of the present invention illustrating a detection field and lost item.

Turning to FIG. 2, the PIMS 10 includes an area of detection indicated by reference numeral 24. The area of detection 24 is a zone of space around the monitor 12 in which the RFID tags 14 may be detected. This area of detection 24 may have a restricted range (e.g., anywhere from 6 meters to 0.5 meters) and is adjustable by the monitor 12. If an item with an attached RFID tag 14, for example item 4 in FIG. 3, leaves the area of detection 24, the monitor 12 will signal an alert, as will be described below.

Figure 3:
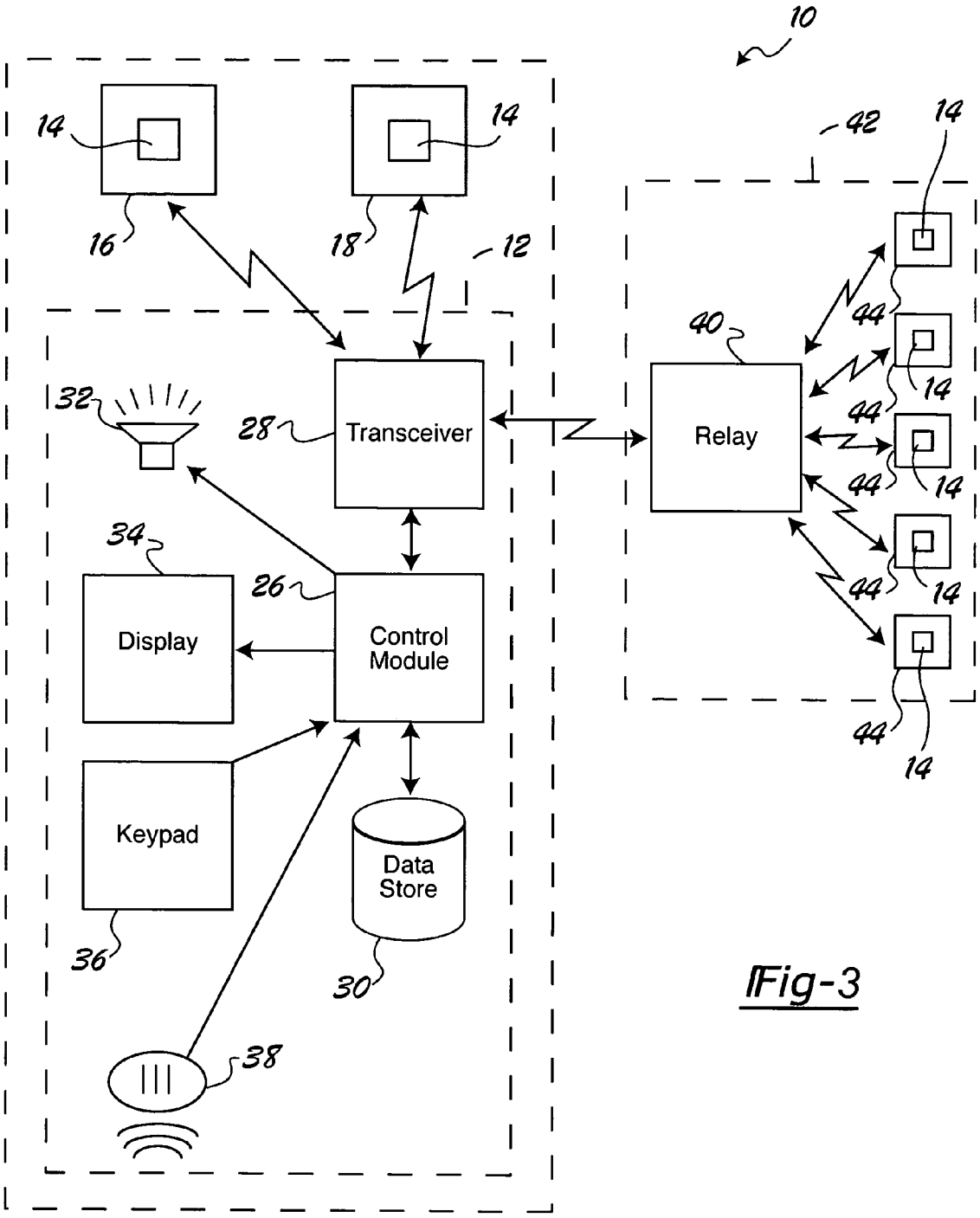
FIG. 3 is a schematic view of the personal item monitoring system of the present invention.

Turning to FIG. 3, the monitor 12 preferably includes a control module 26 in electronic communication with a transceiver 28 and a data store 30. The control module 26 is an electronic processing unit used to control the PIMS 10. The transceiver 28 is in electronic wireless communication with the RFID tags 14 and receives a return signal therefrom when the RFID tags 14 are within the area of detection 24 (FIG. 2). The data store 30 is a memory device for storing the RFID tags 14 and associated data.

The monitor 12 further includes an audio output 32 (e.g. a speaker), a display device 34 (e.g. a screen), a keypad 36, and an audio input 38 (e.g. a microphone), all in electronic communication with the control module 26.

To enter a specific RFID tag 14 into the PIMS 10, a user enters a menu system (or other software hierarchy) displayed on the display device 34. For each RFID tag 14 within the area of detection 24 (FIG. 2), a corresponding entry appears on the display 34. A user then labels each entry (corresponding to a particular RFID tag 14) using either the keypad 36 or speaking into the audio input 38 and using speech recognition software to label the entries. This data is then stored in the data store 30.

When a particular RFID tag 14 leaves the area of detection 24 (as illustrated in FIG. 2), the transceiver 28 no longer receives an incoming return signal. The control module 28 identifies which particular RFID tag 14 is no longer returning a signal and alerts the user that an item is missing. This alert can include, for example, using speech synthesis software to announce "Your wallet is missing" or by sounding an audio alert signal using the audio output 32.

In the case where the monitor 12 is a cellular phone, the alert may consist of ringing the cellular phone as if a call were present and using speech synthesis to inform the user which item is missing and for how long the item has been missing. This feature can also be used to provide an alert if the cellular phone is stolen, e.g., by making the system call a pre-selected phone number when the cellular phone and RFID tags 14 become separated. Furthermore, to prevent unauthorized usage in such circumstances, the cellular phone could disable itself unless a password is entered.

The PIMS 10 may further include a relay 40. The relay 40 is a remote device having an independent power source and transceiver. The relay 40 is in wireless electronic communication with the transceiver 28 of the monitor 12 and has an area of detection (not shown) similar in use to the area of detection 24 in FIG. 2. However, the range of the relay 40 may be greater or smaller. In the particular example provided, the relay 40 may be placed within a home environment 42 with a plurality of items 44 (such as, for example, televisions, computers, stereos, etc.). Each of the items 44 includes an RFID tag 14. If an RFID tag 14 is removed from the home environment 42 (which in turn preferably corresponds to the area of detection of the relay 40), the relay 40 signals the monitor 12 which particular RFID tag 14 is no longer returning a signal. The monitor 12 may then alert a user using one of the methods described above. In an alternate embodiment, the relay 40 may be shaped like a credit card and placed in a wallet or purse to monitor the items located within the wallet or purse.

In the event of a "reader collision" (e.g. more than one monitor transmitting a signal on the frequency used by the RFID tags 14), the control module 26 preferably includes an algorithm for deactivating the signal from the monitor 12. For example, the transceiver 28 will receive the broadcast signal from another transmitting monitor or other device. The control module 26 will then know the monitor 12 is in a "hot spot" (e.g., an area where a signal using the same frequency as the RFID tags 14 already exists). The control module 26 then suspends the signal from the monitor 12 until such time as the monitor 12 is no longer within the "hot spot". This feature will prevent "reader collision" and save power during the suspended use.

The user can deactivate monitoring any individual RFID tag 14 in the event that the user is not carrying a particular item by deactivating or removing the item from the monitor 12. Moreover, a clock in the monitor 12 can be programmed to look for a user's item at a certain time, for example, in the morning before leaving the house, such that the user does not forget to take the item with the user. Finally, the PIMS 10 may be used to find lost items that have been tagged with one of the RFID tags 14. By moving the location of the monitor 12, the user can determine if the particular item missing is within the area of detection 26 and the monitor 12 may be programmed to alert the user with an audible noise or using speech synthesis to indicate that the item is nearby. By monitoring the strength of the returning radio signal from the RFID tag 14, the monitor 12 can notify the user whether the user is getting closer or farther away.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for monitoring personal items in an item monitoring system comprising:

monitoring a first set of radio frequency identification tags found within a first detection range of a portable monitor, where said first set is associated with personal items to be monitored;

monitoring a second set of radio frequency identification tags found within a second detection range of a second monitor, where said second set is associated with other personal items to be monitored; and providing an alert by the portable monitor when at least one radio frequency identification tag of said first set exceeds said first detection range or when at least one radio frequency identification tag of said second set exceeds said second detection range, wherein the second monitor notifies the portable monitor that one radio frequency identification tag of said second set has exceeded said second detection range.

2. The method of claim 1, wherein said portable monitor is a cellular phone.

3. The personal item monitoring system method of claim 2, wherein said cellular phone is programmed to dial a pre-selected phone number to alert said user when said at least one radio frequency identification tag of said first set leaves said first detection range.

4. The method of claim 2, wherein said cellular phone is disabled when said at least one radio frequency identification tag leaves said first detection range until a password is entered into said cellular phone.

5. The method of claim 1, wherein said portable monitor is a PDA device.

6. The method of claim 1, wherein said first set of radio frequency identification taps includes an adhesive for adhering to said personal items and said second set of radio frequency identification taps includes said adhesive for adhering to said other personal items.

7. The method of claim 1, wherein said portable monitor can be temporarily deactivated to cease monitoring said at least one radio frequency identification tag of said first set and said second monitor can be temporarily deactivated to cease monitoring said at least one radio frequency identification tap of said second set.

8. The method of claim 1, wherein said at least one radio frequency identification tap of said first set emits a first return signal received by said portable monitor upon receiving a first radio frequency signal from said portable monitor when said at least one radio frequency identification tap of said first set is within said first detection range and;

said at least one radio frequency identification tap of said second set emits a second return signal received by said second monitor upon receiving a second radio frequency signal from said second monitor when said at least one radio frequency identification tap of said second set is within said second detection range.

9. A method of claim 8, wherein said portable monitor alerts said user when said portable monitor fails to receive said first return signal or when said second monitor fails to receive said second return signal.

10. The method of claim 1, wherein said portable monitor is used to locate said at least one radio frequency identification tag of said first set by determining a strength of a returning signal from said at least one radio frequency identification tag of said first set.

11. The method of claim 1, wherein said portable monitor includes a menu system for listing said at least one radio frequency identification tag of said first set and said second monitor includes a second menu system for listing said at least one radio frequency identification tag of said second set.

12. The method of claim 1, wherein said portable monitor includes speech recognition capabilities to input the name of said personal item coupled with said at least one radio frequency identification tag of said first set and said second monitor includes speech recognition capabilities to input the name of said other personal item coupled with said at least one radio frequency identification tag of said second set.

13. The method of claim 1, wherein said alert from said portable monitor includes a synthesized voice identifying said personal item coupled with said at least one radio frequency identification tag of said first set or said other personal item coupled with said at least one radio frequency identification tag of said second set.

14. The method of claim 1, wherein said monitoring system can be temporarily activated or deactivated for said at least one radio frequency identification tag of said first set using a clock in said portable monitor and wherein said monitoring system can be temporarily activated or deactivated for said at least one radio frequency identification tag of said second set using a clock in said second monitor.

15. An item monitoring system comprising:

a portable monitor having a transmitter and a receiver located therein;

a first set of radio frequency identification tags found within a first detection range of said portable monitor;

a second monitor having a second transmitter and a second receiver therein;

a second set of radio frequency identification tags found within a second detection range of said second monitor, said portable monitor provides an alert when at least one radio frequency identification tag of said first set exceeds said first detection range or when at least one radio frequency identification tag of said second set exceeds said second detection range, wherein the second monitor notifies the portable monitor that one radio frequency identification tag of said second set has exceeded said second detection range.

16. A system of claim 15, wherein said at least one radio frequency identification tag of said first set emits a first returning signal received by said portable monitor upon receiving a first radio frequency signal from said portable monitor when said at least one radio frequency identification tag of said first set is within said first detection range and;

said at least one radio frequency identification tag of said second set emits a second returning signal received by said second monitor upon receiving a second radio frequency signal from said second monitor when said at least one radio frequency identification tag of said second set is within said second detection range.

17. A system of claim 15, wherein said portable monitor alerts said user when said portable monitor fails to receive said first return signal or when said second monitor fails to receive said second return signal.

18. A system of claim 15, wherein said portable monitor wirelessly communicates with said second monitor.

19. A system of claim 15, wherein said second monitor operates from a predetermined location.

20. A system of claim 15, wherein said second monitor is portable.

21. A system of claim 15, wherein said portable monitor is temporarily disabled if said at least one radio frequency identification tag of said first set exceeds said first detection range until an authentication input is accepted by said portable monitor.

22. A system of claim 15, wherein said at least one radio frequency identification tag of said first set is adapted to be coupled to a personal item and said at least one radio frequency identification tag of said second set is adapted to be coupled to an other personal item.

23. A system of claim 15, wherein said system can be temporarily enabled or disabled for said at least one radio frequency identification tag of said first set based on time and wherein said system can be temporarily enabled or disabled for said at least one radio frequency identification tag of said second set based on time.

24. A system of claim 15, wherein said alert from said portable monitor includes at least one of: 1) signaling an external device; 2) generating an audio output; 3) generating a visual output; or 4) generating a pulsation.

25. A system of claim 15, wherein said portable monitor and said second monitor are capable of receiving input including at least one of: 1) manual input; 2) audio input; or 3) signaled input.

* * * * *

UNITED STATES PATENT AND TRADEMARK OFFICE

CERTIFICATE OF CORRECTION

PATENT NO. : 7,034,684 B2
APPLICATION NO. : 10/751851
DATED : April 25, 2006
INVENTOR(S) : Robert Boman et al.

It is certified that error appears in the above-identified patent and that said Letters Patent is hereby corrected as shown below:

Col. 4, Line 46, Claim 3:
Delete "personal item monitoring system"

Col. 4, Line 58, Claim 6:
"taps" should be --tags--

Col. 4, Line 60, Claim 6:
"taps" should be --tags--.

Col. 4, Line 67, Claim 7:
"taps" should be --tags--.

Col. 5, Line 2, Claim 8:
"taps" should be --tags--.

Col. 5, Line 5, Claim 8:
"taps" should be --tags--.

Col. 5, Line 7, Claim 8:
"taps" should be --tags--.

Col. 5, Line 11, Claim 8:
"taps" should be --tags--.

Signed and Sealed this

Thirtieth Day of January, 2007

JON W. DUDAS
*Director of the United States Patent and Trademark Office*